US006662621B1

(12) United States Patent
Amherd

(10) Patent No.: US 6,662,621 B1
(45) Date of Patent: Dec. 16, 2003

(54) PRESSING TOOL APPARATUS AND CONTROL METHOD

(75) Inventor: René Amherd, Reutlingen (CH)

(73) Assignee: Von Arx AG, Sissach (CH)

( * ) Notice: Subject to any disclaimer, the term of this patent is extended or adjusted under 35 U.S.C. 154(b) by 306 days.

(21) Appl. No.: 09/721,226

(22) Filed: Nov. 22, 2000

(65) Prior Publication Data

(65)

(30) Foreign Application Priority Data

Nov. 24, 1999 (CH) ..... 2148/99

(51) Int. Cl.[7] ..... B21J 9/18; B21D 7/06

(52) U.S. Cl. ..... 72/453.16; 72/453.15; 72/31.01; 72/31.11

(58) Field of Search ..... 72/453.15, 453.16, 72/31.11, 31.01

(56) References Cited

U.S. PATENT DOCUMENTS

| | | | | | |
|---|---|---|---|---|---|
| 2,910,108 | A | * | 10/1959 | Fike | 72/31.11 |
| 4,936,126 | A | * | 6/1990 | Sato | 72/31.1 |
| 5,111,681 | A | * | 5/1992 | Yasui et al. | 72/453.15 |
| 5,113,679 | A | * | 5/1992 | Ferraro et al. | 72/453.16 |
| 5,611,228 | A | | 3/1997 | Dummermuth | |
| 5,666,848 | A | * | 9/1997 | Burns | 72/453.16 |
| 5,730,022 | A | * | 3/1998 | Hansson et al. | 72/453.16 |

FOREIGN PATENT DOCUMENTS

| | | |
|---|---|---|
| DE | 196 31 019 A1 | 8/1997 |
| DE | 299 05 357 | 6/1999 |
| DE | 198 14 202 A1 | 10/1999 |
| DE | 100 00 868 A1 | 7/2001 |
| EP | 0 712 696 A1 | 5/1996 |
| EP | 0 858 850 A1 | 8/1998 |
| EP | 0 941 813 A1 | 12/1998 |

* cited by examiner

*Primary Examiner*—David B. Jones
(74) *Attorney, Agent, or Firm*—Pauley Petersen & Erickson

(57) ABSTRACT

A pressing tool apparatus with a clamping pincer and a sensory mechanism that permits a measurement of a displacement which the piston covers with the closure procedure of the clamping pincer. With the first closure of the clamping pincer, without a pressing, there results a nominal displacement value which is realized by a displacement sensor and a ring magnet. Electronics in the housing store a measured nominal value and compares it to subsequent closure procedures with a pressing, accounting for programmable tolerance values. Pressings within a permitted range or outside the range are suitably displayed.

9 Claims, 2 Drawing Sheets

PRESSING TOOL APPARATUS AND CONTROL METHOD

BACKGROUND OF THE INVENTION

1. Field of the Invention

This invention relates to a method for controlling an electrically operated pressing tool apparatus for pressing coupling elements with a clamping pincer. This invention also relates to a pressing tool apparatus used according to the method of this invention.

2. Description of Related Art

Pressing tool apparatus of the above mentioned type are used for pressing coupling elements, such as press sleeves, press fittings, connecting sleeves, and tube sections which are inserted into one another. The pressing tool apparatus includes a clamping pincer with clamping jaws which form a pressing space for receiving the coupling element to be pressed. The pressing pressure required for the pressing can be delivered by a hydraulic drive.

After each pressing, the pressing tool should be checked whether the coupling element has been pressed to the desired extent or whether the pressing force was too great or too small. The testing is visibly controlled. If the degree of the pressing is only just outside the tolerance limit, then it is difficult to visibly recognize. Furthermore the visual control depends on the reliability of the worker.

A pressing tool apparatus is a working apparatus which has an increased accident risk. Already, many accidents have occurred at work because the pincers are accelerated away in an uncontrolled manner and the fork-like receiver is spread open and deformed.

Therefore according to European Patent Reference EP-A 0 712 696, a monitoring element monitors the connection bolt in its completely inserted position and via a switch element is in connection with the drive motor.

Also when the clamping pincer is correctly held in the pressing tool apparatus, this alone still does not ensure a perfect pressing of the tubular workpiece. Reasons for the qualitatively unsatisfactory pressings may be very varied. Apart from reasons which are connected to the function of the pressing tool apparatus, other reasons are considered which are related to the inadequate machining. For example, the clamping pincer and its clamping jaws may become dirty, and thus a sufficient closure of the clamping pincer is not achieved or the dimensioning of the applied connecting sleeve or pressing sleeve does not correspond to the dimension which is envisaged for the corresponding pincer.

For these reasons, according to European Patent Reference EP-A 0 858 850, there is known a pressing tool apparatus with which the applied pressing pressure is determined and it is ascertained whether this pressing pressure lies within the predefined tolerance limits. Thus, a full closure of the clamping pincer is achieved. So that a monitoring may be effected correctly, the pressing tool apparatus must recognize which clamping pincer is operative. Such a clamping pincer recognition requires an electronic data exchange between the clamping pincer and the pressing tool apparatus, as well as an electronic logic through which the information may be evaluated to suitable signals which indicate a correct or incorrect pressing. Such electronic monitoring may then, without problem, be combined with further electronic information which also displays the correct actuation and the perfect operating condition of the pressing tool apparatus.

Since these pressing tools are often used on building sites, it is difficult to not dirty the clamping pincer. Such contamination then often leads to interruptions of the electronic transfer and thus to erroneous information.

Finally there is also known a pressing tool apparatus, for example from German Patent Reference DE-A 19 631 019, wherein an end pressing position of the pressing jaws is monitored. Accordingly the clamping pincers perceive this end pressing position and convey a signal to a display means. Also here an information transfer from the clamping pincer to the pressing tool apparatus must be effected. Also, suitable electronics must be integrated into the clamping jaws to likewise sensitive mechanical elements.

SUMMARY OF THE INVENTION

According to known art, information must be delivered from the clamping pincer to the pressing tool apparatus. It is thus one object of this invention to provide a method which does not require electrical or electronic data communication from the clamping pincer to the pressing tool apparatus but which itself procures this information.

This object is achieved with a method and an apparatus described in this specification and in the claims.

It is another object of this invention to provide a pressing tool apparatus which may function according to the method according to this invention. This object is achieved by a pressing tool apparatus with the features described in this specification and in the claims.

BRIEF DESCRIPTION OF DRAWINGS

The drawings show features of this invention, wherein.

DESCRIPTION OF PREFERRED EMBODIMENTS

Figure 1:
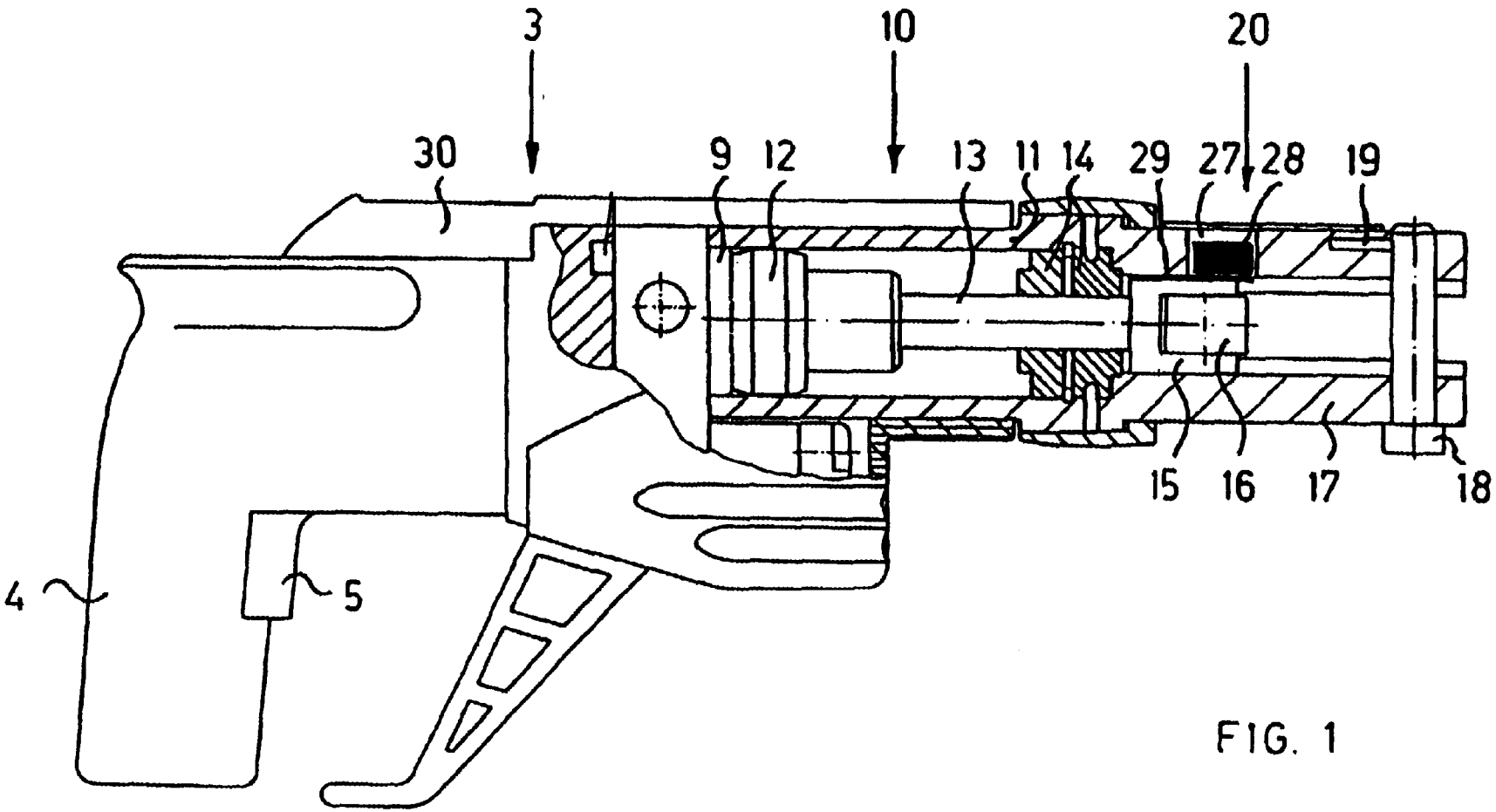
FIG. 1 is a partial cross-sectional view of a device with a displacement measurement sensory mechanism arranged between a roller holder and a fork-like receiver.
Figure 2:
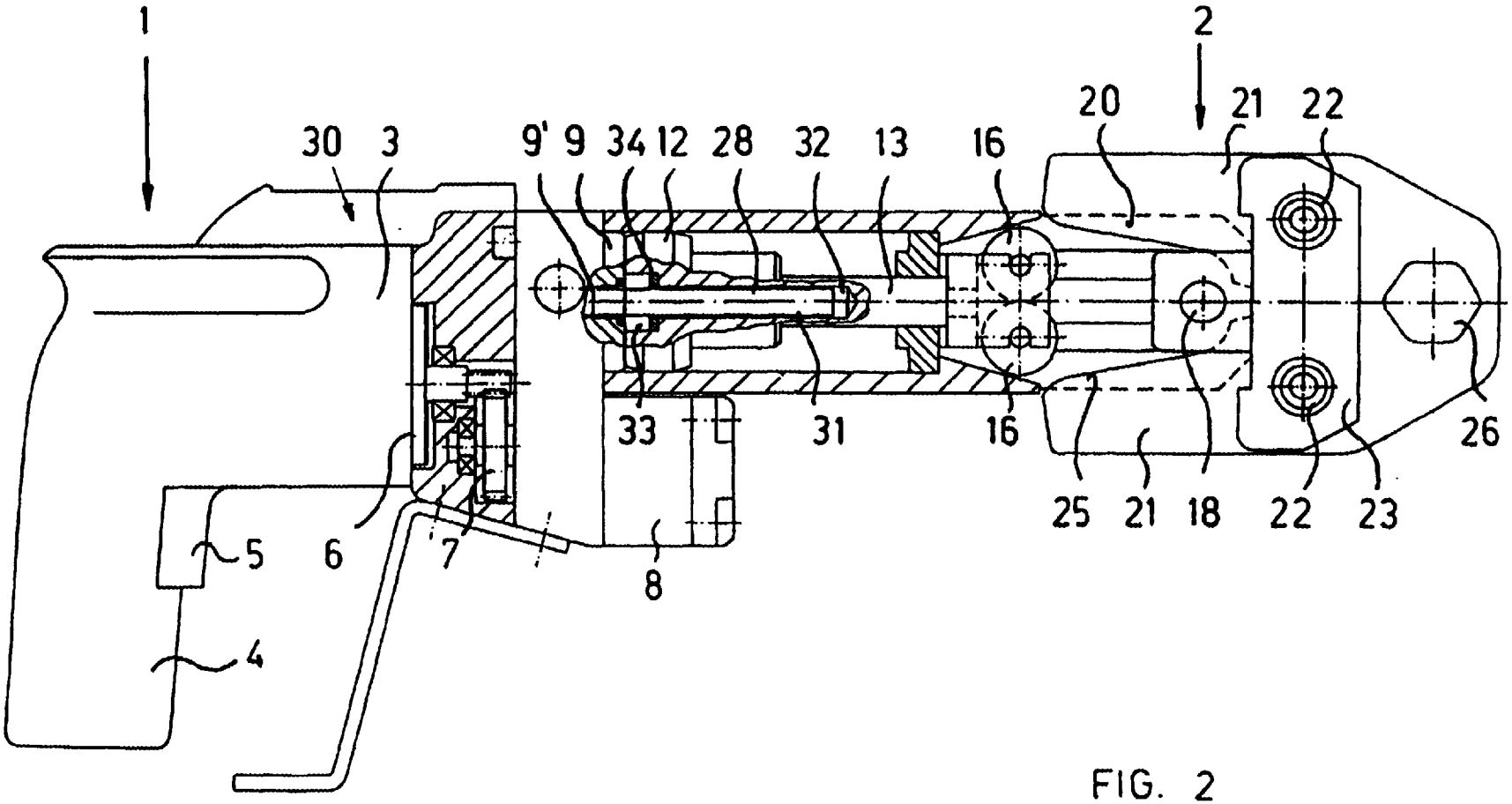
FIG. 2 is a partial cross-sectional view of a pressing tool apparatus having a displacement measurement sensory mechanism integrated in a piston/cylinder unit.

FIG. 1 only shows a pressing tool apparatus 1, while FIG. 2 shows the pressing tool apparatus 1 and an applied clamping pincer 2. The pressing tool apparatus 1 comprises an electro-hydraulic apparatus which is formed as a pistol. The apparatus 1 has a housing 3 with a grip 4. On the grip 4 is arranged a trigger switch 5 via which a pressing procedure is triggered. The electromotoric drive 6 accommodated in the housing 3, via a gear 7, acts on a hydraulic pump 8 which presses hydraulic oil from a storage supply into the cylinder and thus moves the piston.

The piston/cylinder unit is indicated as element reference numeral 10 and comprises a cylinder 11 and a piston 12 movable within the cylinder 11. On the piston 12 there engages a piston rod 13 which is led through a two-part bearing 14. At the end lying opposite the piston 12 on the piston rod 13 there is arranged a roller holder 15. The roller holder 15 has a yoke shape in which there are mounted two rollers 16. An extension of the cylinder housing 11 is milled in and thus forms two cheeks 17 which form the fork-like receiver 20. Transverse to a longitudinal direction of the cheeks 17, a securing bolt 18 passes through the fork-shaped receiver 20. A monitoring sensor 19 monitors the correct position of the securing bolt 18. The securing bolt 18 passes through the bearing plates or a connection tab of the clamping pincer 2. For exchanging the clamping pincer 2 in each case the securing bolt 18 must be removed.

On actuation of the trigger switch 5 hydraulic oil is pressed through the cylinder head 9 into the cylinder 11. Accordingly, the piston 12 is displaced to the right in the drawing. To the same extent the piston rod 13 with the roller holder 15 fastened thereon moves to the right. Thus the rollers 16 bear on ramp-like surfaces 25 on the inner surfaces of the two clamping jaws 21 of the clamping pincer 2 and the two clamping jaws 21 pivot about the two corresponding rotation bearings 22 which are arranged in the bearing plates 23. The bearing plates 23 may be configured such that the securing bolt 18 passes through the bearing plates 23, or between the two bearing plates 23 there may be arranged a corresponding fastening tab through which the securing bolt 18 passes. With the last-mentioned version correspondingly larger and wider clamping pincers may be produced. In the position of the piston 12 shown in FIG. 2 and correspondingly the position of the roller holder or the rollers, the clamping pincer 2 may be opened. If the rollers 16 move to the right onto the ramp-like surfaces 25, then the clamping jaws 21 on this side of the rotational bearing 22 are pressed apart and correspondingly pressed together on the other side, wherein the clamping space 26 is reduced in size so that the tubular workpiece lying therein is pressed together.

In the embodiment shown in FIG. 1, in one of the two cheeks 17 of the fork-like receiver 20 there is a recess 27 in which is arranged a sensor that can determine a stroke displacement. The sensor can be a magnet sensor, a magneto-resistive angle sensor, a displacement sensor, a rotation sensor, a path sensor or a Hall sensor. In the present case a displacement sensor is in corresponding active connection with a magnet strip 29 which is fastened on the roller holder 15. With the magnet strip 29, a platelet in a close arrangement is subdivided alternately in strips in plus and minus poles. On actuation of the apparatus 1, the roller holder 15 and thus the magnet strip 29 located thereon moves past under the sensor 28 which at the same time obtains counting pulses corresponding to the changing poles. The number of the detected counting pulses is directly proportional to the stroke displacement of the piston and of the roller holder 15. With a clamping pincer remaining the same the unchanging stroke displacement corresponds to the unchanging closure movement of the clamping pincer, which accordingly leads to an unchanging pressing.

With the use of a magneto-resistive angle sensor this may be accommodated in the cylinder seal through which the piston rod 13 is guided. The piston rod 13 can have magnetized regions, wherein the magnetizing directions are different. The magneto-resistive sensor determines a vector which corresponds to an absolute position of the piston rod. This preferred embodiment form eliminates a destruction with the exchange of the clamping jaws.

With regard to the method, after placing in the clamping pincer 2 the trigger lever 5 is actuated without a workpiece, to be pressed, introduced into the clamping space 26. Accordingly the clamping pincer 2 may completely close in an unhindered manner. If the clamping pincer 2 is completely closed then the pressure in the cylinder space increases to a limit value which is defined by way of an incorporated excess pressure valve which is not shown in the drawings. If the corresponding pressure is reached the valve switches over and the hydraulic oil can flow back out of the cylinder 11 directly into the storage oil tank. Since usually a torsion spring or return spring is integrated which leads the pincer back into the relieved position, accordingly also the piston 12 is displaced back into the original position. It is also possible with the switch-over of the excess pressure value to repole the rotational direction of the hydraulic pump and to actively lead back the oil.

The number of signals detected with the first pincer closure is supplied to electronics 30 accommodated in the housing 3. The electronic circuit contains a data memory, a comparator and possibly further conventional means for storing a nominal displacement value and to input tolerance ranges lying thereunder or thereabove, and a computation unit which compares the determined actual displacement value with the fixed nominal displacement value and checks whether the actual displacement value lies within a fixed tolerance range.

One particular advantage of this invention is that the determined nominal displacement value represents a relative value which depends on the clamping pincer type and even on each individual clamping pincer, since such clamping pincers also display wear, by which means the tolerance would practically always become larger. With systems which proceed from absolute values, accordingly the clamping pincers must either be replaced earlier or re-adjusted. Every time the clamping pincer is again applied, by way of the previously described empty closure the real closure displacement is determined and is newly acquired as the nominal displacement value. Because on the clamping pincer there are required neither mechanical detection elements nor electronic data transmission elements, the entire system is extraordinarily unsensitive with daily use and all fitting clamping pincers may be used and monitored.

FIG. 2 shows a second embodiment which differs from the first described embodiment only with respect to the arrangement of the sensor and the type of the sensor. In the cylinder head 9 there is centrically arranged a hollow cylindrical pin 31. This pin 31, fixedly mounted in the cylinder head 9, projects into the piston 12 and the piston rod 13 into a pocket bore. The corresponding pocket bore 32 is so large in diameter that the pin 31 may project therein without contact. In the head of the piston 12 there is arranged a widened bore 33 in which is fixedly held a magnet ring 34. In the hollow pin 31 there is attached a wire which is arranged straight or wound and which with the movement along the magnet ring 34 induces a signal which in turn is evaluated at the electronic circuit 30. Also, here the signal is proportional to the stroke displacement of the piston 12. The evaluation of the signal is effected just as with the previously described solution. Also here the clamping pincer itself determines the nominal stroke displacement and the corresponding tolerances may be programmed in the circuit by the manufacturer. The user has no access to the nominal value tolerance adjustment.

In contrast to the known systems the control system for monitoring the clamping pincer of this invention is not controlled via pressure. The hydraulic pressure is subject to considerable fluctuations which depend on external influences which may hardly be taken into account. In particular, the viscosity is an important parameter. The viscosity of the hydraulic oil also depends on the temperature. With the solution described, there is an excess pressure valve which is only switched on when reaching a certain safety value that may lie relatively high above the possibly required pressing pressure. The pressure is basically applied so high that the pincer may securely close. Accordingly, this value is not at all critical for the actual pressing which is one advantage of this invention.

In order to avoid erroneous information the electronic circuit in the pressing tool apparatus may be connected so that with the absence of the voltage at the pressing tool apparatus, the stored nominal displacement value is deleted. Thus, it is ensured that the clamping pincer is exchanged while the apparatus is switched off, when switching on again one does not proceed from an incorrectly stored value. This would not be a tragedy because then the inputted nominal displacement value is short whereas the apparatus perceives this pressing as a new empty pressing and the thus detected value is stored as a new nominal displacement value and also this procedure is suitably optically and/or acoustically displayed. It is desirable that on starting work again after exchanging the clamping pincer there is a new empty pressing or full pressing and this empty pressing is determined as a reference.

In an analogous manner, the exchanging of the clamping pincer may also be monitored and suitably on removal of the clamping pincer the stored nominal displacement value deleted. This may be effected most simply if one uses the withdrawal and re-insertion of the securing bolt 18 as information. This is possible without any problem because the sensor 19 is present, which monitors the securing bolt 18. Accordingly, the information of the sensor 19 must only be logically coupled to the information of the sensor 28.

What is claimed is:

1. In a method for controlling an electrically operated pressing tool apparatus (1) for pressing a coupling element with a clamping pincer (2), wherein the pressing tool apparatus (1) moves a hydraulically actuatable piston (12) until reaching a predetermined pressure and then closes the clamping pincer (2), the improvement comprising:

actuating the pressing tool apparatus (1, 5) after an insertion of the clamping pincer (2);

registering a displacement of the piston (12) upon reaching the predetermined pressure as a nominal displacement value up to a settable tolerance;

comparing each effective displacement value of every subsequent pressing procedure to the nominal displacement value;

activating a signal upon a deviation of the effective displacement value of every subsequent pressing from the nominal displacement value; and deleting the stored nominal value displacement upon no voltage at the pressing tool apparatus (1).

2. In a method for controlling an electrically operated pressing tool apparatus (1) for pressing a coupling element with a clamping pincer (2), wherein the pressing tool apparatus (1) moves a hydraulically actuatable piston (12) until reaching a predetermined pressure and then closes the clamping pincer (2), the improvement comprising:

actuating the pressing tool apparatus (1, 5) after an insertion of the clamping pincer (2);

registering a displacement of the piston (12) upon reaching the predetermined pressure as a nominal displacement value up to a settable tolerance;

comparing each effective displacement value of every subsequent pressing procedure to the nominal displacement value;

activating a signal upon a deviation of the effective displacement value of every subsequent pressing from the nominal displacement value; and deleting the stored nominal displacement value upon an exchange of the clamping pincer (2).

3. A method according to claim 1, wherein on falling short of the stored nominal displacement value a lower value is recognized as an erroneous pressing and is at least one of optically and acoustically displayed.

4. In an electrically operated pressing tool apparatus (1) having an electrically operated hydraulic pump (8) which acts on a hydraulic piston-cylinder unit (10) in active connection with a roller holder (15) having rollers (16) that roll onto the clamping jaws (21) of a clamping pincer (2) and move the clamping jaws (21) relative to one another, wherein the clamping pincer (2) is exchangeable and held in a fork receiver, the improvement comprising: the apparatus (1) having a logic circuit and a sensor in data-transmitting communication with the logic circuit, wherein the sensor determines a stroke displacement of a piston.

5. In the pressing tool apparatus according to claim 4, wherein the sensor is one of a magnet sensor, a magnet field sensor, a path sensor, a Hall sensor and a rotation sensor.

6. In the pressing tool apparatus according to claim 4, wherein the sensor is in the fork receiver and a magnet strip is on a part connected to the piston.

7. In the pressing apparatus according to claim 4, further comprising a open hollow-cylindrical pin projecting into the piston, wherein one of the sensor and a magnet is in the open hollow-cylindrical pin and the open hollow-cylindrical pin is surrounded by the other of the magnet and the sensor fixedly fastened on one of the piston and the piston rod.

8. In the pressing tool apparatus according to claim 7, wherein a hydraulic pressing pressure bears on an outside of the hollow-cylindrical pin.

9. In the pressing tool apparatus according to claim 5, wherein the sensor is a magneto-resistive sensor in a region of a piston rod mounting and detects a magnetic field angle of magnetic fields on the piston rod and delivers a signal to the logic circuit.

* * * * *